United States Patent [19]

Brown et al.

[11] 4,031,613

[45] June 28, 1977

[54] CLOSED BARREL TERMINAL APPLICATOR

[75] Inventors: Christopher Kingsley Brown, Camp Hill; Donald Andrew Wion, Harrisburg, both of Pa.

[73] Assignee: AMP Incorporated, Harrisburg, Pa.

[22] Filed: Mar. 4, 1976

[21] Appl. No.: 663,882

[52] U.S. Cl. ..... 29/628; 29/753

[51] Int. Cl.[2] ..... H01R 43/00

[58] Field of Search .... 29/203 D, 203 DT, 203 DS, 29/628

[56] References Cited

UNITED STATES PATENTS

| | | | |
|---|---|---|---|
| 2,545,756 | 3/1951 | Andren | 29/203 D |
| 3,264,860 | 8/1966 | Herb | 29/203 DS |

*Primary Examiner*—Lowell A. Larson

*Attorney, Agent, or Firm*—William J. Keating; Robert W. Pitts

[57] ABSTRACT

Wire feeding means which can be used with conventional wire crimping presses are disclosed. A movable funnel is used to precisely position the wires in a crimping station. Movement of the funnel in synchronization with the terminal feed mechanism extracts the wire from the crimping station and relative movement of the wire and the funnel releases the wire from the funnel. A wire gripping channel into which a wire is positioned grips the wire and moves it through the funnel into the crimping station. A sensor which detects the presence of the wire in the channel is located between a barrel and the crimping station. These elements combine to move the uncrimped wire longitudinally into the crimping station and then move the crimped wire laterally out of the crimping station.

14 Claims, 12 Drawing Figures

12
2
16
8
74
108
106
11

CLOSED BARREL TERMINAL APPLICATOR

BACKGROUND OF THE INVENTION

1. Field of the Invention

This invention relates to a terminal applicator for crimping closed barrel electrical terminals to the stripped end of a wire. More particularly, this invention relates to a manual feed mechanism which assists an operator to rapidly position successive wires in position for attaching a terminal. This invention also is directed to the rapid lateral movement of wires out of a crimping station.

2. Description of the Prior Art

Semi-automatic wire crimping machines for attaching open or closed barrel terminals to wires having stripped ends are disclosed in the prior art. These machines can be relatively simple. Four principle parts must be included in each machine. A movable punch and a stationary anvil perform the actual crimping, but terminal feeding and wire feeding means are also required. In general, such machines employ laterally or longitudinally fed strips of individual terminals. In the more simple and less expensive machines, which are of particular interest in connection with this invention, the wire feeding strip is often performed by hand.

U.S. Pat. No. 3,553,814 discloses a terminal applicator which has a reciprocable punch and stationary anvil and an automatic means for feeding strip mounted terminals. That device employs a continuous belt which advances the strip mounted terminals into, through, and out of a crimping station. This belt is linked to the movable punch and proper movement of the strip mounted terminals occurs in sequence with the crimping operation. A rotatable arm is attached to the strip feed mechanism. This arm is located adjacent to the crimping station. This arm moves in sequence with the belt. The arm is intended to remove a crimped wire from the crimping station as a new terminal is advanced for crimping. The instant invention comprises a feed mechanism which can be used with a terminal applicator consistent with that disclosed in U.S. Pat. No. 3,553,814.

Pertinent examples of manual assist wire feeding apparatus are disclosed and claimed in U.S. Pat. Nos. 3,804,603 and 3,883,939. Each of these prior art references, move the wire laterally of its axis into the crimping or terminal application station where the wire pauses while a terminal is crimped around its stripped end. The wire is then moved laterally out of the crimping station. It should be noted that lateral movement alone is insufficient where the wire must be poked into a closed barrel.

Applications which employ funnel members adjacent to a crimping zone are disclosed in U.S. Pat. Nos. 3,214,957, 3,416,213 and 3,710,483.

SUMMARY OF THE INVENTION

The primary purpose of this invention is to provide a significant increase in the speed with which wires can be terminated with conventional semi-automatic applicators. Relatively simple wire feeding devices offer one prospect for increasing the speed of semi-automatic applicators without incurring undue expense. The instant invention is directed to an apparatus which is intended specifically for closed barrel terminals in which the wire must be poked longitudinally into the terminal. This apparatus could also be used with open barrel terminals. Of course, wires may be layed into an open barrel terminal, making wire handling less complex.

An additional impediment to rapid semi-automatic wire handling is the necessity to shield the moving or crimping parts of the apparatus from the operator. An example would be the guards required by federal safety standards. The presence of these guards hinder the operator as he attempts to insert a wire into a closed barrel located in the crimping zone. Essentially, the instant invention is an attempt to aid the operator to precisely position the wire. By reducing the precision required on the part of the operator, cycle time for standard machines should be significantly reduced.

This invention utilizes a funnel located immedately adjacent to the crimping station. The funnel can provide a larger target of the wire as well as acting to correct any misalignment of the wire which occurs in the other parts of the device. As a rule, wires all generally possess some degree of curvature rather than being perfectly straight. When such a curved wire is mechanically gripped near its center, the end will be misaligned. This curvature would result in a misalignment of the end to be terminated. The location of the funnel near the crimping station provides automatic realignment of the wire end. Another example of misalignment occurs when stranded wire is to be crimped in a closed barrel. The strands at the end of the wire could be frayed. The funnel would have a tendency to dress the frayed ends so that they could be inserted into the barrel.

Inserting the wire into a barrel is only one portion of the wire handling problem which must be overcome in the attempt to increase the speed of operation. Means must be provided for removing the wire from the crimping station, from the funnel, and releasing the wire after termination. The wires normally terminated in these machines are somewhat pliable and the tendency exists for them to resist lateral movement. This invention utilizes a movable spring loaded funnel to impart lateral momentum to the wires. Rapid reciprocable movement of the funnel is used as a means to extract the wire both from the crimping station and from the funnel itself.

This invention achieves the object of increased speed with minimal costs and overcomes the just mentioned problems by using the following approach. A wire is gripped at a point spaced from the end to which a terminal is to be attached. The wire is then moved longitudinally of its axis through a restriction comprising a wire positioning funnel. This funnel is located adjacent to the crimping station. Two modes of operation are envisioned. In the first, the wire is poked through the funnel by an operator without mechanical assistance. In the second mode, the operator positions the wire in a wire gripping channel. In the second mode, the channel walls constrict to grip the wire and begin its movement along its axis. A sensor which detects the bared or stripped end of a wire is used to detect the presence of the wire prior to insertion into the crimping station. The wire can be layed into a wire gripping channel having constricting sidewalls. This wire crimping channel is movable in the direction of its axis. One wall is retractable to allow the wire to move laterally of its own axis out of the channel after termination. This invention also utilizes a hinged spring loaded movable funnel to impart lateral momentum to the wire after crimping. The two modes described above differ only in the wire insertion stage. Wire extraction occurs in the same manner in each mode.

DETAILED DESCRIPTION OF THE INVENTION

Figure 1:
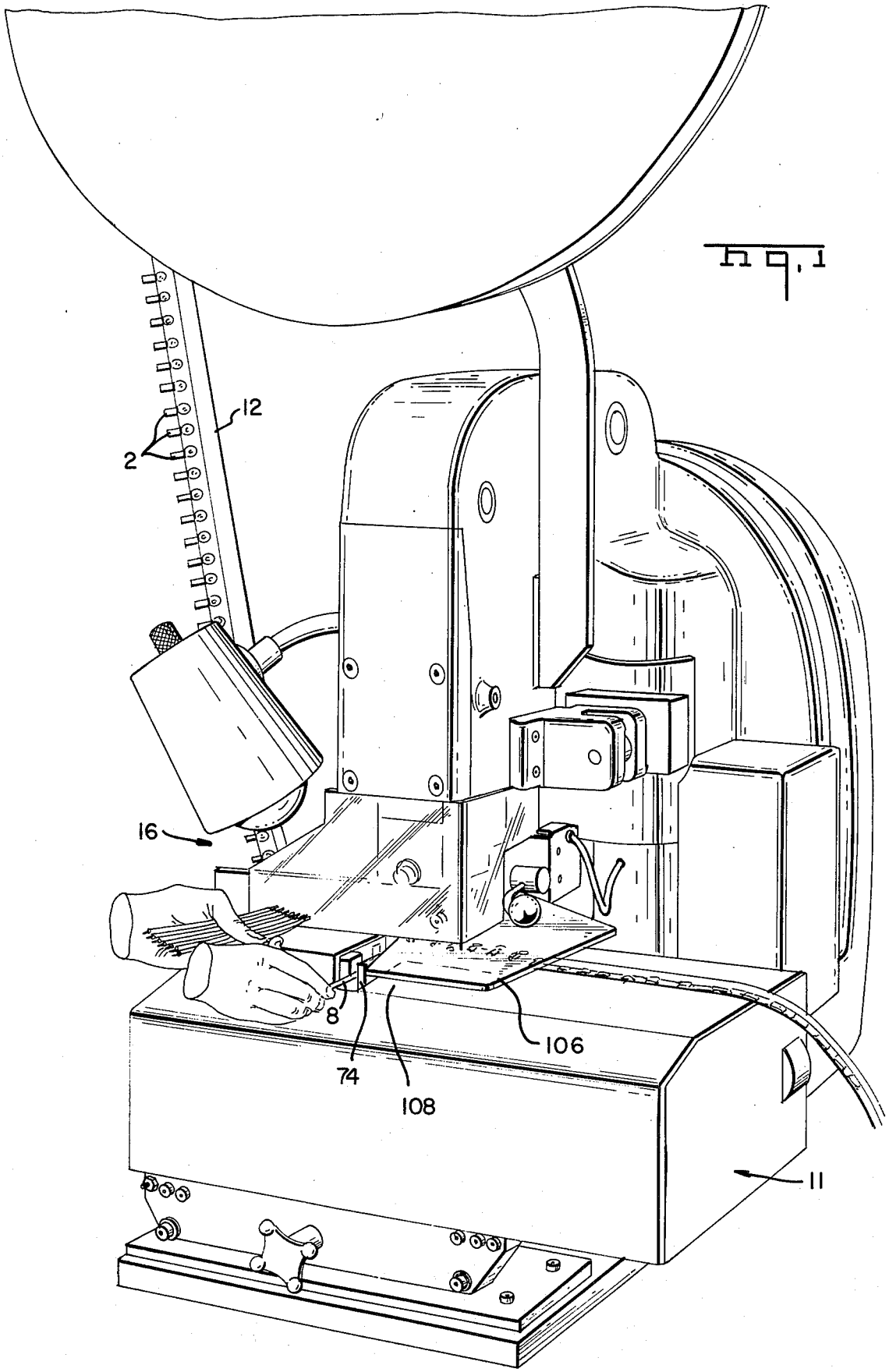
FIG. 1 shows the closed barrel terminal applicator and wire feeder.
Figure 2:
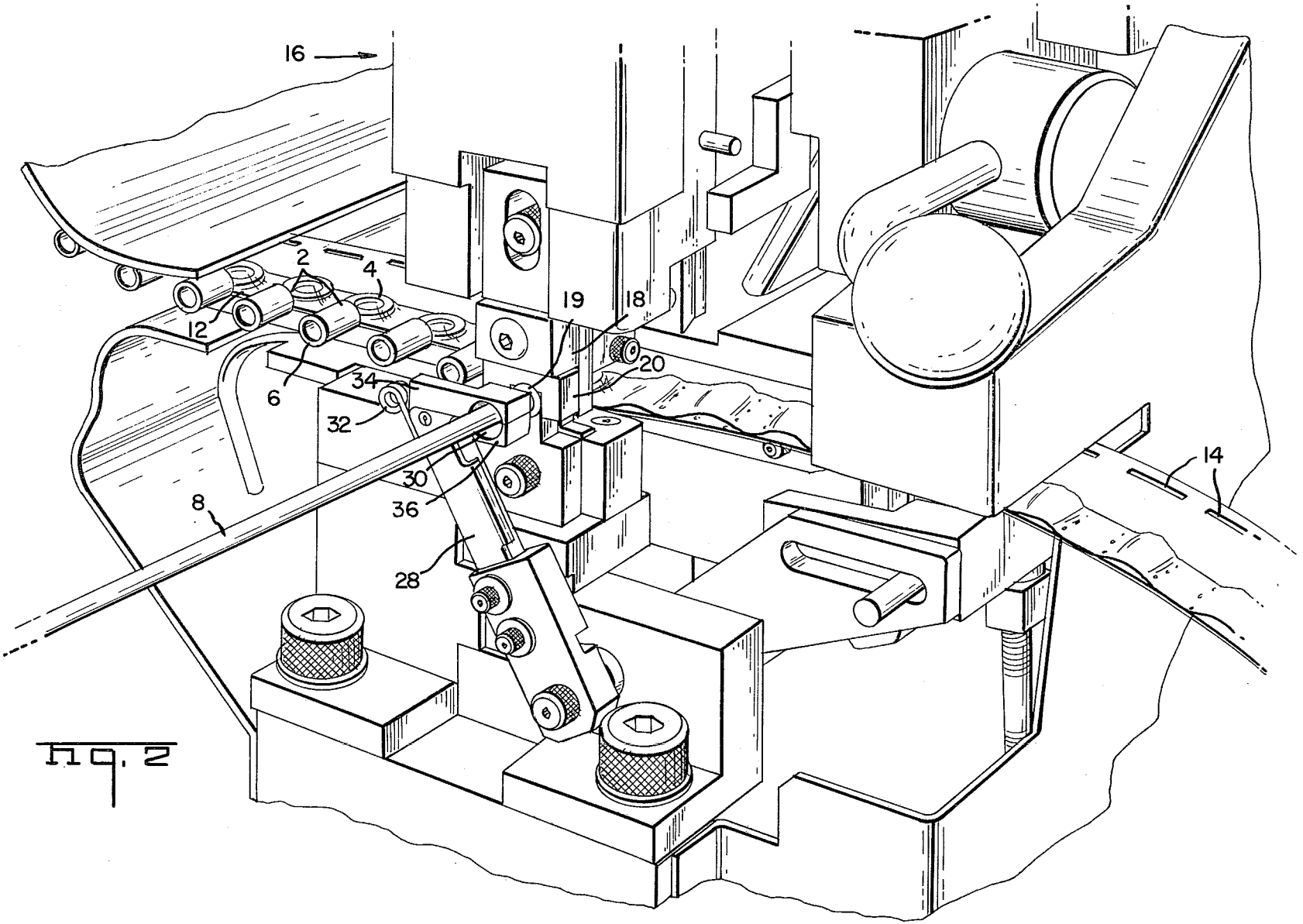
FIG. 2 shows a crimping station with movable punch and anvil and the wire positioning funnel.

One conventional method of applying terminals to the stripped end of the electrical wires to crimp the barrel or ferrule of the terminal around the wire end. Standard terminal crimping applicators employ a movable punch having a crimping surface, a stationary anvil, and means for feeding terminals into a crimping station located at the conjunction of the movable punch and the anvil.

The terminal feeding means employed with this invention is similar to that disclosed in U.S. Pat. No. 3,553,814. Terminals 2 are attached to a carrier strip 12 and extend laterally therefrom. The carrier strip can be formed from a suitable plastic such as Mylar (polyethyleneterephthalate). Strip 12, shown here has ring tongue 4 of terminal 2 encapsulated between two strips of plastic with the barrel 6 extending laterally from one side. Slots or holes 14 are located along the other side of the carrier strip. Suitable teeth on the terminal feed means engage these slots to advance the strip, and of course, the attached terminals into crimping station 19 from a first side, through, and then out of the crimping station on an opposite second side. The terminal feeding means disclosed in U.S. Pat. No. 3,553,814 performs this feeding operation and also severs the terminals from carrier strip 12.

The wire feed mechanism 11 depicted in the embodiment shown is intended for use with a standard terminal applicator and terminal feed assembly. This wire feed mechanism 11 comprises a wire gripping jaw, a wire end sensor, and a wire positioning funnel attachment. The assoicated circuitry moves a stripped wire along axis, through the wire positioning funnel and into a closed cylindrical terminal barrel located in a crimping station.

The wire jaw assembly is located in the upper center of the wire feed apparatus. This wire gripping jaw assembly comprises a laterally clamping member 70 and an upright barrier member 76. Members 70 and 76 define an elongated channel 74. The width of channel 74 varies as clamping member 70 moves toward channel member 76. Channel 74 is in alignment with the crimping station located at the conjunction of movable punch 18 and anvil 20.

A wire end sensor 50 is located between the channel 74 formed by members 70 and 76, and the crimping station 19. Wire end sensor 50 comprises two blocks of electrically conductive material on either side of a central insulating strip 56. Sensor blocks 52 and 54 have inwardly sloping faces 53 and 55. Faces 53 and 55 form a V with central insulating strip 56 being located at the appex of this V. Faces 53 and 55 and the open end of the V are in alignment with channel 74 and face away from crimping station 19 toward channel 74. Blocks 52 and 54 are electrically connected, but insulating strip 56 prevents completion of any circuit. Sensor 50 is located on a sensor slide 104 and is movable laterally from the position shown in FIG. 3 to a position to the left of crimping station 19, and channel 74, as viewed in FIG. 3. A lever 68 is located on the left end of sensor slide 104. Sensor 50 is moved along sensor slide 104 by activation of lever 68. As end 69 of lever 68 is moved to the right in FIG. 3, the sensor 50 moves to the left along the slide.

Figure 3:
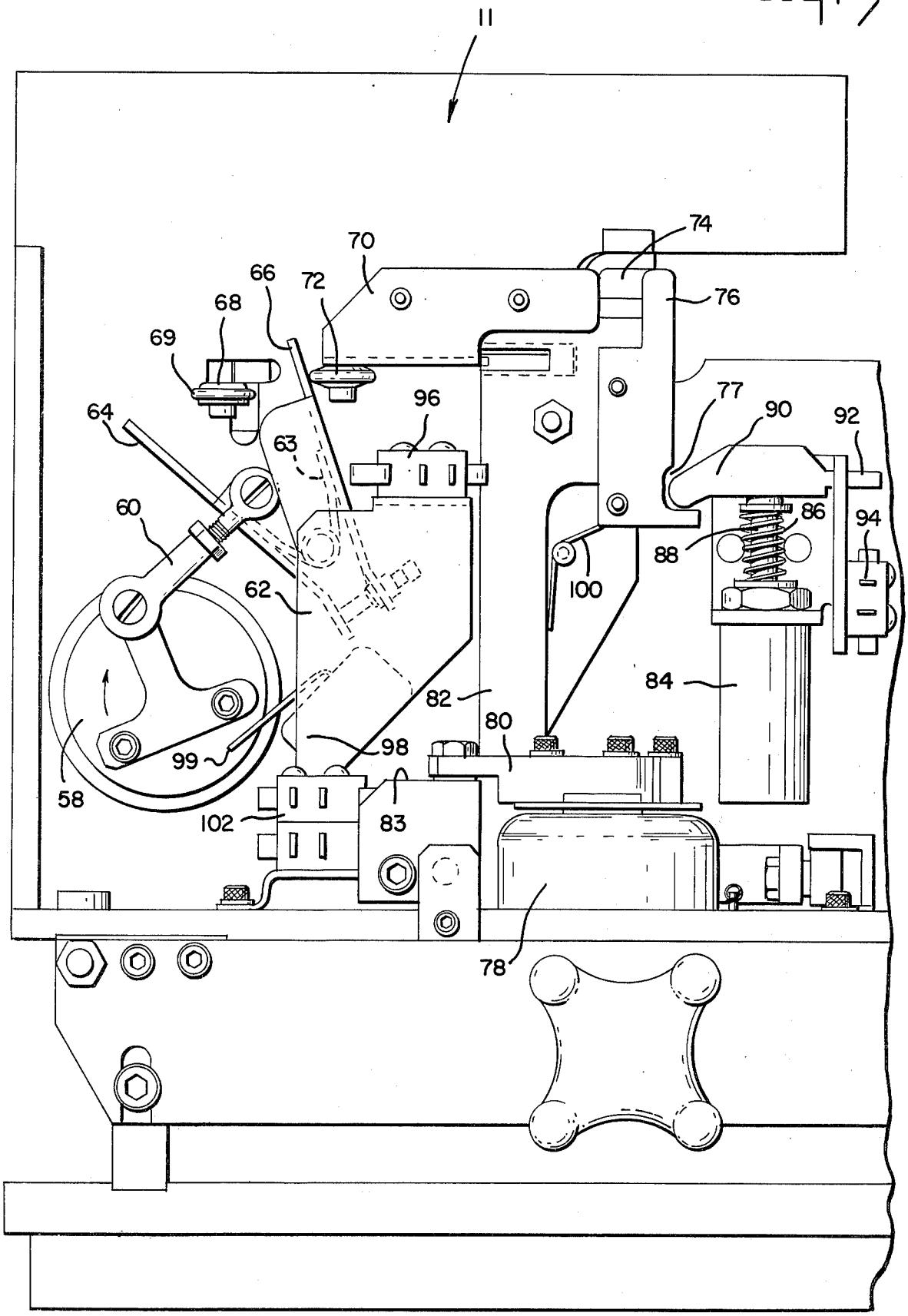
FIG. 3 is a front view of the wire feeding mechanism.
Figure 4:
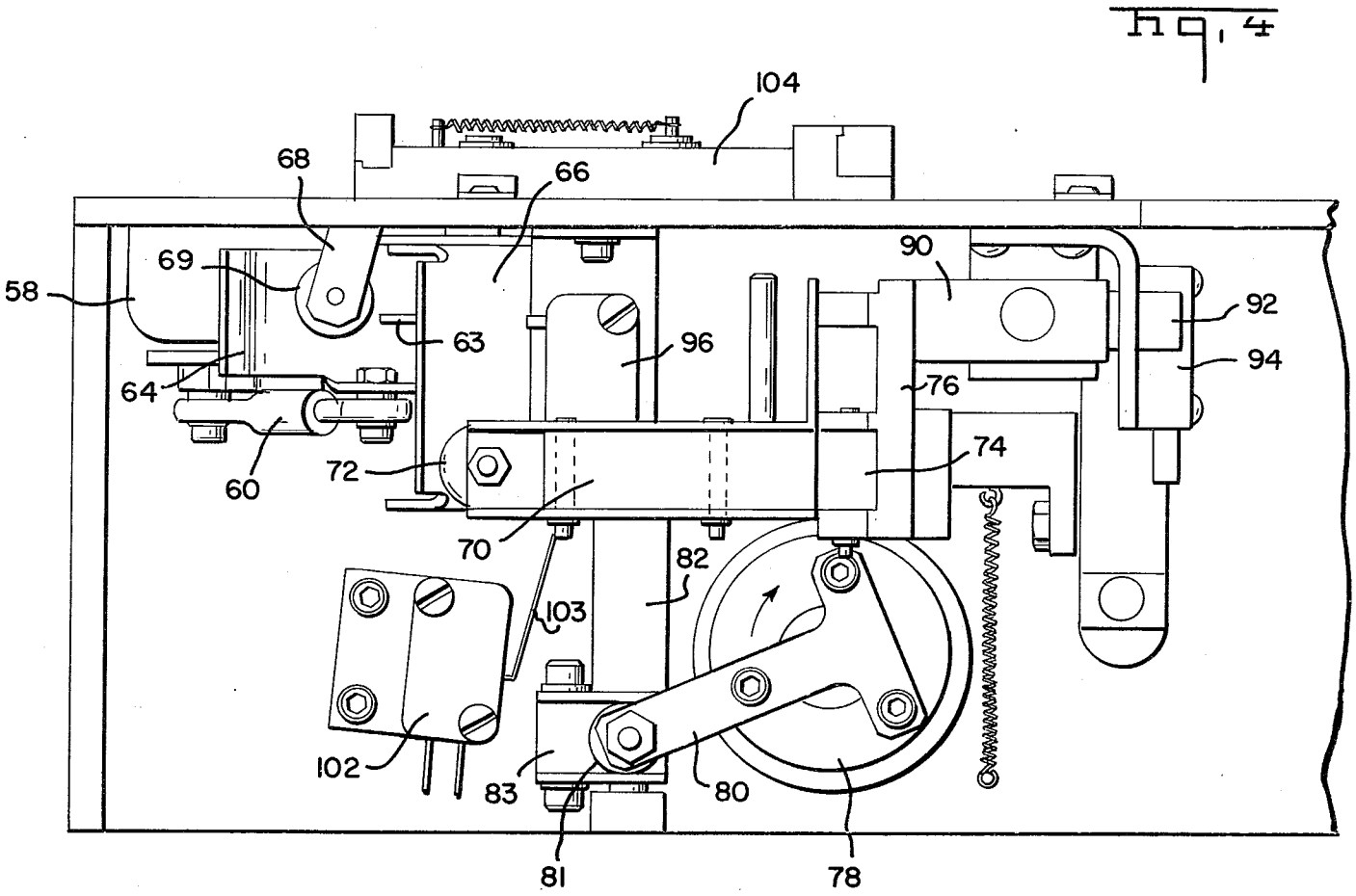
FIG. 4 is a top view of the wire feeding mechanism.
Figure 5:
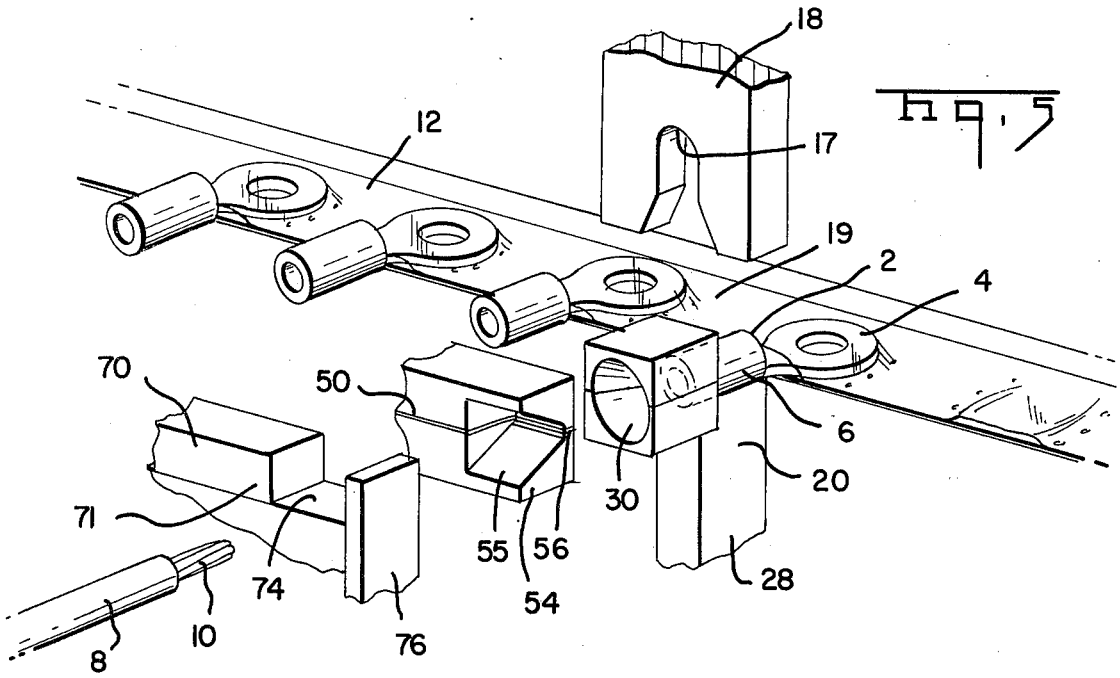
FIG. 5 is a diagramatic view showing the relative positioning of the press, anvil, terminals, funnel, sensor, wire gripping jaws, and one wire. The various elements are in their initial orientation.

A clothespin-type actuator 62 is located to the left of clamping member 68 as shown in FIG. 3. Actuator 68 comprises two plate-like members 64 and 66 which are biased away from each other by the action of spring 63. A rotary solenoid 58 is attached to the plate-like member 64 by means of lever arm 60. Rotary solenoid 58 rotates in a clockwise direction as shown by the arrow. As solenoid 58 and arm 60 rotate, plate-like member 64 also rotates in a clockwise direction. Member 64 soon abuts end 69 of sensor lever 68 which in turn results in movement of sensor 50 away from the position occupied in FIG. 4. As plate 64 moves under the action of solenoid 58, a force is transmitted through spring 63 to cause clockwise rotation of plate 66. Plate 66 initially comes into contact with follower wheel 72 which is attached to the left end of clamping member 70. Clockwise rotation of plate 66 therefore drives clamping member 70 to the right toward barrier member 76.

A second rotary solenoid 78 is located below channel 74. Solenoid 78 rotates in a clockwise direction when viewed from above as in FIG. 4. Solenoid 78 rotates about an axis which is perpendicular to the axis of rotation of solenoid 58. Arm 80 is located on the top of solenoid 58 and a follower wheel 81 is attached to the end of arm 80. Wheel 81 is located in channel 83. Channel 83 is in turn located onthe bottom portion of bracket 82. The wire gripping jaw, comprising clamping member 70 and barrier member 76, is located on the top of bracket 82. Rotation of solenoid 78 causes follower wheel 81 to travel along channel 83 and drives bracket 82 toward the crimping station 19. Of course, this also results in movement of the wire gripping means towards the crimping station.

Solenoid 84 is located beside barrier member 76. Linear solenoid 84 moves piston 88 along a path generally parallel to the axis of rotation of solenoid 78. Actuator head 90 is located on the top piston 88 as shown in FIG. 3. Head 90 engages barrier member 76 as shown at 77. Upon activation of solenoid 84, head 90 moves down against a force member 76 also travels with head 90, moves down barrier member 76 also travels with head 90, thereby opening one side of the channel 74.

Actuation of the three solenoids and proper cycling of the machines is controlled by a series of appropriately positioned limit switches. Limit switch 96 is located below clamping member 70. If channel 74 is empty, thus permitting clamping member 70 to essentially contact wall 76, plate 66 will activate limit switch 96. If limit switch 96 is activated, the operational cycle of the mechanism is interrupted, and returns to starting conditions, since there is no wire present in channel 74.

Limit switch 98 is located below limit switch 96 and is adjacent to solenoid 58. Arm 99 extends from switch 98. As solenoid 58 rotates, the actuating arm will eventually depress arm 99 thus activating switch 98. Activation of switch 98 triggers solenoid 78 which in turn drives the entire wire gripping assembly toward the crimping station.

As solenoid 78 moves the wire gripping assembly toward the crimping station, channel 83 eventually depresses switch arm 83 on limit switch 102. Upon activation of limit switch 102, two operations are initiated. First movable punch 18 is activated and a wire barrel 6 is crimped around the stripped wire end 10 of a wire 8. Limit switch 102 is also attached to solenoid 84 through an appropriate time delay. After this time delay, solenoid 84 retracts barrier 76. Head 90 has an actuating arm 92 extending from the right side in FIG. 3. Actuating arm 92 triggers limit switch 94 which deactivates solenoid 84. Head 90 is then driven upward by the action of spring 86. Activation of the limit switch 94 also results in deactivation of rotary solenoid 78. Appropriate springs then return the wire gripping assembly and the sensor to their initial positions.

A transparent guard 106 is shown in FIG. 1. This guard is intended to prevent injury to the operator by preventing the operator from placing his fingers between moving parts. Note that a slot 108 is provided to permit passage of the terminated wires out of the crimping station. Clearance must also be allowed for inserting the wire into the crimping station by laying the wire into the wire gripping channel or inserting the wire into the enclosed conical funnel. Note that funnel 30 is adjacent to crimping station 19 and recessed from guard 106. Funnel provides a larger target of wire end 10, without that wire is gripped in channel 74 or is poked into the funnel by the operator.

OPERATION

FIGS. 5 through 9 illustrate the basic steps of wire feeding and extraction performed with this invention. In FIG. 1 it is apparent that individual closed barrel terminals 2 mounted on carrier strips 12 are sequentially moved into crimping station 19 between movable punch 18 and anvil 20. Terminal barrel 6 is located in crimping station 19 directly below crimping surface 17.

Figure 6:
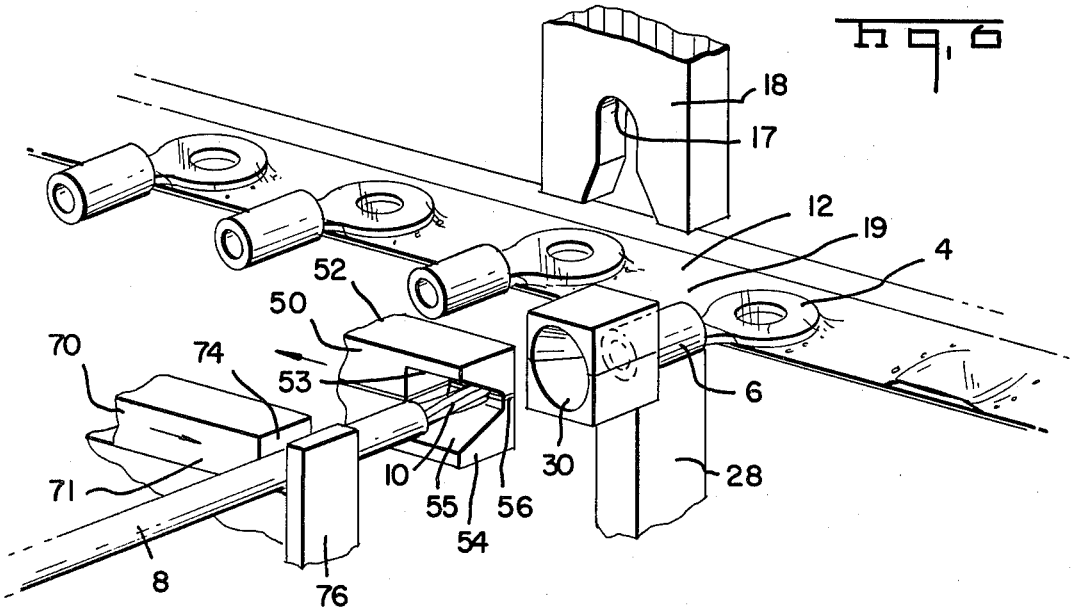
FIG. 6 shows a continuation of FIG. 5 showing the operation of the sensor and wire gripping jaws.
Figure 7:
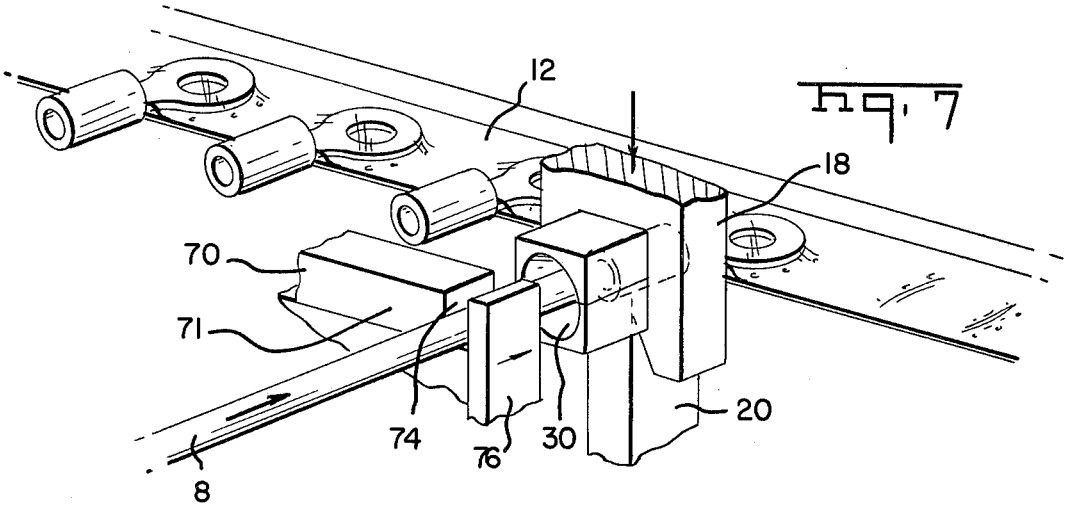
FIG. 7 is a continuation of FIG. 6 showing the movement of a wire into a terminal barrel and its subsequent crimping.
Figure 8:
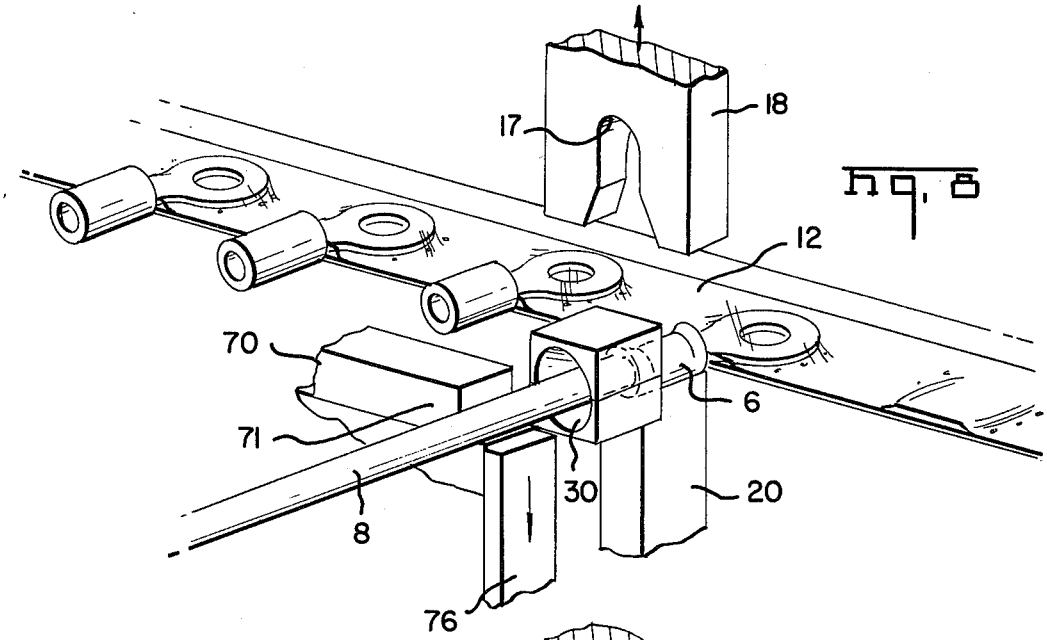
FIG. 8 is a continuation of FIG. 7 showing the initiation of the wire removal step.
Figure 9:
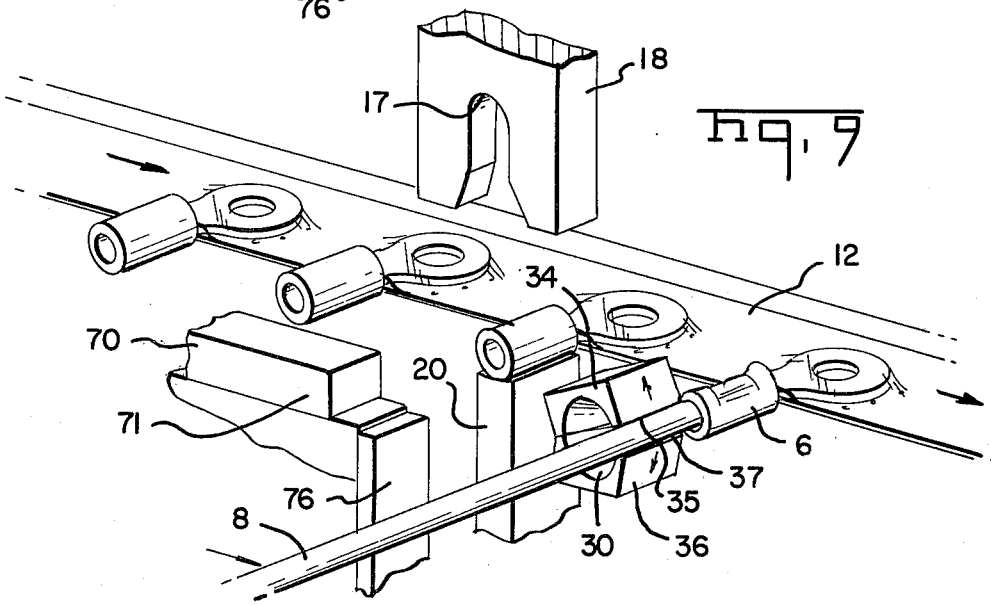
FIG. 9 is a continuation of FIG. 8 showing removal of the wire from the funnel.
Figure 10:
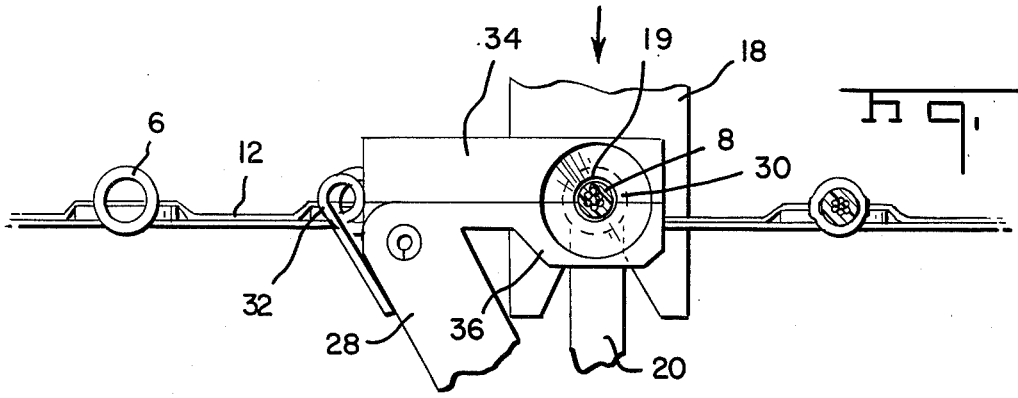
FIG. 10 is a diagramatic view focusing on the funnel and wire in an initial position.

A single wire 8 having a stripped end 10 is shown in general alignment with crimping station 19. In an applicator of this type, wires are normally fed individually, by hand, into crimping station 19. Utilizing the wire feeder, each wire is advanced toward crimping station 19 as shown in FIG. 6. Before a wire can enter crimping station 19, it strikes sensor 50. Sensor 50 is located in front of crimping station 19. FIG. 6 shows stripped end 10 of wire 8 extending into the V formed by sensor faces 53 and 55. Stripped wire end 10 can now complete an electrical circuit between sensor blocks 52 and 54. Thus an appropriate signal indicating that a wire is positioned in channel 74 without precise horizontal alignment is transmitted to the wire feeder. Upon receipt of this signal from sensor 50, clamping member 70 moves to secure the wire 8 in channel 74. The wire is now gripped as shown. Sensor 50 then moves clear of the crimping station 19 as shown by the arrow in FIG. 6. Wire gripping means 71 then moves wire 8 along axis through funnel 30 and into barrel 6 located in crimping station 19. Movable punch 18 is then activated and barrel 6 is crimped around wire end 10 as shown in FIG. 7. FIG. 8 shows the retraction of movable punch 18. At roughly the same time, barrier member 76 is retracted as shown in FIG. 8. Wire 8 is no longer held in channel 74. FIG. 9 shows the movement of a terminated wire out of the crimping station 19. Carrier strip 12 has advanced one position and a new terminal has been located in the crimping station. Funnel 30 has also advanced simultaneously with the movement of carrier strip 12. Funnel 30 is shown in FIG. 9 with jaws 34 and 36 separated to release the wire 8.

Figure 11:
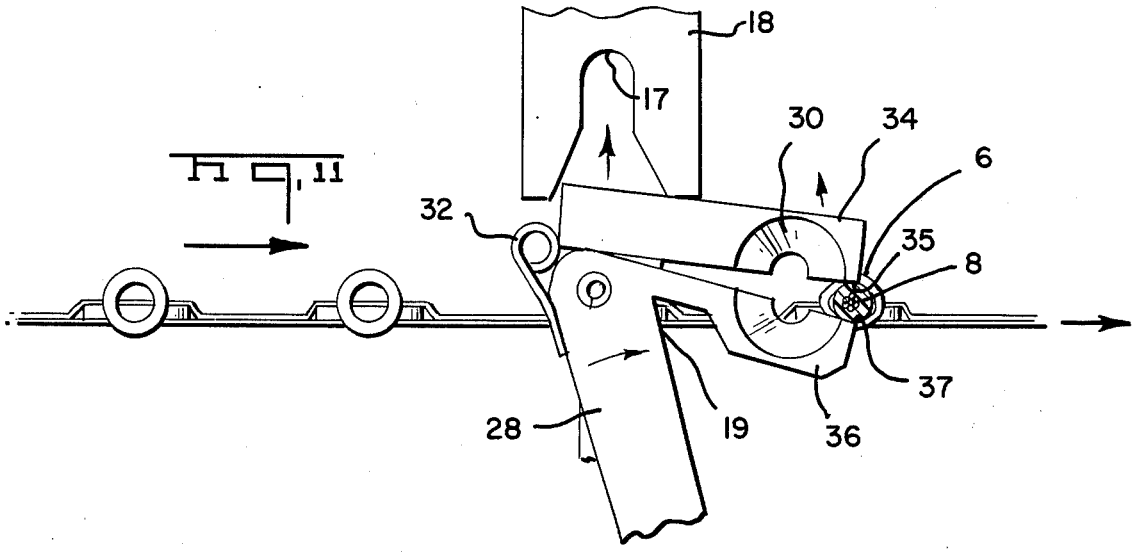
FIG. 11 is a continuation of FIG. 10 showing the lateral extraction of the wire from the funnel.
Figure 12:
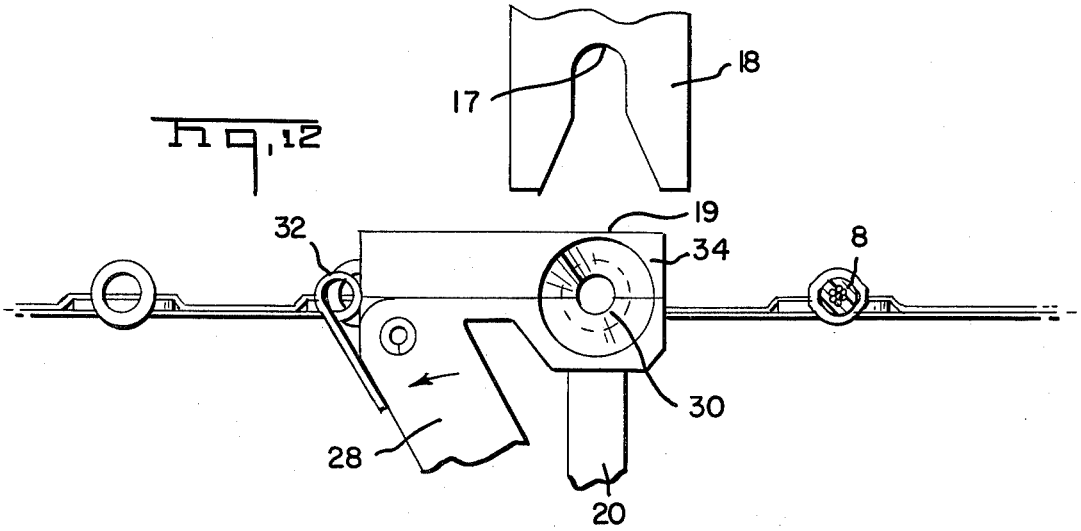
FIG. 12 is a continuation of FIG. 11 showing completion of the wire removal operation.

After barrel 6 has been crimped around wire end 10, wire 8 moves laterally out of crimping station 19. Wire 10 has been moved by the combined action of strip 12 and funnel 30. After the crimping operation, terminal 2 is no longer securely attached to strip 12. U.S. Pat. No. 3,553,814 describes the method in which the terminal has been partially freed from strip 12 in a conventional crimping press of the type used herein. The strip does, however, continue to execute some lateral force on terminal 2. Funnel 30 also exerts a lateral force on the wire at a point near terminal 2. The wire is accelerated to the right when viewed in FIG. 11, giving the wire momentum in that direction.

Unlike the other elements in this invention, funnel 30 is attached directly to applicator 16, and is activated by the carrier strip advance apparatus. The remaining elements of the wire feature are positioned adjacent to the applicator. Only funnel 30 is mechanically linked to the applicator apparatus. The other portions of the wire feed are electrically linked to the applicator so that an appropriate feeding and crimping cycle can be maintained.

A wire is extracted from crimping station 19 by the movement of funnel 30 along a slightly arcuate path. Motion of strip 12 alone cannot be relied upon to remove a wire from the crimping station. While it is not apparent from FIG. 9, the ring tongue 4 of a crimped terminal has been at least partially separated from carrier strip 12 during the crimping operation of FIG. 7. A finite amount of momentum must be imparted to wire 8. Wire 8 receives this linear momentum, directed to the right as shown in Figures as it is kicked by funnel 30. Funnel 30 rotates through a clockwise arc of approximately 30 degrees. The funnel then immediately returns to the initial position as shown in FIG. 9. As the funnel returns to its initial position, its momentum is instanteously opposite to that earlier imparted to the wire 8. This momentum difference equals the force available for extracting wire 8 from funnel 30. The upper and lower jaws 30 and 36 are spring loaded relative to each other. The extraction force due to the oppositely directed momentum of the wire and funnel acts against free ends 35 and 37 against spring 32. Jaws 34 and 36 are thus opened relative to wire 8. In this particular embodiment, upper funnel jaw 34 is fixed with respect to funnel arm 28. Lower jaw 36 can rotate clockwise against the action of spring 32. Upper jaw 34 is fixed because it serves one additional purpose. Upper jaw 34 acts to strip crimped barrier 6 from crimping surface 17 during the upward retraction of movable punch 18.

The embodiment illustrated and described in this application demonstrates an appropriate technique for increasing the operating speed of conventional crimping presses. The invention embodied herein is not limited solely to specific structure illustrated. Numerous other embodiments could differ in detail while not departing from the scope and contact of the invention disclosed and claimed herein.

We claim:

1. In an apparatus for applying terminals, each having an enclosed cylindrical barrel, to the end of wires including:

a crimping press comprising a crimping anvil and a crimping die movable relatively towards and away from said anvil; a crimping zone formed at the convergence of said anvil and said die; and terminal advance means for sequentially and laterally advancing equally spaced strip mounted individual terminals into said crimping zone from a first side and out of said crimping zone on an opposite second side, the improvement comprising:

a conical wire positioning funnel located in a first position adjacent to and spaced from said crimping zone with the axis of said funnel in alignment with a terminal barrel located within said crimping zone, said funnel being free to move from said first position to a laterally displaced second position in sequence with the movement of a terminal barrel out of said crimping zone on said second side, said funnel being also free to subseqently return from said second position to said first position, and hinge means allowing said funnel to open when said funnel is in the vicinity of said second position, whereby one of said wires may be aligned with and inserted into an enclosed cylindrical terminal barrel by use of said funnel whereupon said barrel is crimped onto said wire and said wire is released from said funnel by said hinge means upon relative movement between said funnel and the crimped wire and barrel.

2. An apparatus as set forth in claim 1 wherein said funnel comprises upper and lower jaws, said jaws being joined by said hinge means adjacent to said first side of said crimping zone.

3. An apparatus as set forth in claim 2 wherein said upper and lower jaws have free adjacent to said second side of said crimping zone, said free ends normally touching each other.

4. An apparatus as set forth in claim 3 wherein said hinge means comprise pivot points and resilient spring means, said upper and lower jaws being free to separate by relative rotation against the action of said spring means, rotation being initiated by a lateral force exerted against the inner surface of said funnel in the vicinity of said free ends.

5. An apparatus as set forth in claim 4 wherein said upper jaw remains fixed with respect to said pivot point and said lower jaw rotates relative to said pivot point and said upper jaw.

6. An apparatus as set forth in claim 4 wherein said apparatus and has a shield located between said funnel and said free end of said wire extending through said funnel, said shield having a slot extending from the vicinity of said crimping zone to and beyond the vicinity of said second position, said slot being positioned so that said wire is free to move through said slot.

7. An apparatus as set forth in claim 1 wherein said terminal advance means imparts a lateral force to said wire upon movement of said wire laterally out of said crimping station.

8. In an apparatus for applying terminals, each having an enclosed cylindrical barrel, to the end of stranded wires including: a crimping press comprising a crimping anvil and a crimping die movable relatively towards and away from said anvil; a crimping zone formed at the convergence of said anvil and said die; and terminal advance means for sequentially and laterally advancing equally spaced strip mounted individual terminals into said crimping zone from a first side and out of said crimping zone on an opposite second side, the improvement comprising:

a wire positioning funnel located adjacent to said crimping zone and in alignment with a terminal barrel located within said crimping zone, a wire sensor for detecting the presence of the end of an electrically conductive wire, and reciprocal wire clamping means for generally aligning the axis of said wire with the axis of said funnel and moving said wire longitudinally towards said crimping zone, said wire sensor normally being positioned between said funnel and said clamping means, whereby upon positioning the end of said wire against said wire sensor said clamping means securely grip said wire and extend the end of said wire through said funnel and into said crimping zone whereupon a barrel is crimped around said wire.

9. An apparatus as set forth in claim 8 wherein said wire sensor comprises two electrically conductive members separated by an insulating member, said conductive members each being connected to a source of electrical power so that the end of said electrically conductive wire completes a circuit when said end of said wire simultaneously contacts both of said conductive members.

10. An apparatus as set forth in claim 9 wherein said conductive members from a V-shaped surface with said insulating member located at vertex of said V-shaped surface.

11. An apparatus as set forth in claim 10 wherein said clamping means comprise the opposite walls of a channel, said channel being generally aligned with the axis of said funnel.

12. An apparatus as set forth in claim 11 wherein one of said walls moves towards and away from the other wall.

13. An apparatus as set forth in claim 12 wherein said other wall is retractable to permit passage of a wire moving laterally out of said crimping zone.

14. A method of attaching a terminal to one end of a wire, said method comprising the steps of, laying the wire in a U-shaped channel with said one end extending beyond said channel, constricting said channel so as to exert pressure on said wire intermediate its ends, moving said wire longitudinally along its axis so that one end is pushed through a restricting enclosed funnel to precisely position said wire in a terminal application station, applying a terminal to said one end of said wire by exertion of a force laterally of the axis of said wire, freeing said wire from said channel and moving said wire laterally of its axis out of said terminal application station by imparting momentum to said wire by moving said funnel.

* * * * *